US007980488B2

(12) United States Patent
Townsend

(10) Patent No.: US 7,980,488 B2
(45) **Date of Patent: *Jul. 19, 2011**

(54) SPRINKLER WITH GEARED VISCOUS HESITATOR AND RELATED METHOD

(75) Inventor: Michael R Townsend, Waitsburg, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 510 days.

This patent is subject to a terminal disclaimer.

(21) Appl. No.: 12/149,264

(22) Filed: Apr. 29, 2008

(65) Prior Publication Data

US 2008/0277498 A1 Nov. 13, 2008

Related U.S. Application Data

(63) Continuation-in-part of application No. 11/409,069, filed on Apr. 24, 2006, now Pat. No. 7,584,904.

(51) Int. Cl.
*B05B 3/04* (2006.01)

(52) U.S. Cl. ..... 239/222.17; 239/252

(58) Field of Classification Search ..... 239/222.11–224, 239/231, 236, 237, 252

See application file for complete search history.

(56) References Cited

U.S. PATENT DOCUMENTS 3,727,842 A 4/1973 Ertsgaard et al.
4,375,513 A 3/1983 Debono et al.
4,836,449 A 6/1989 Hunter
4,836,450 A 6/1989 Hunter
RE33,823 E * 2/1992 Nelson et al. ..... 239/222.17
5,192,024 A 3/1993 Blee
5,372,307 A 12/1994 Sesser
5,671,886 A 9/1997 Sesser
7,584,904 B2 * 9/2009 Townsend ..... 239/222.17

OTHER PUBLICATIONS

U.S. Appl. No. 12/149,264, filed Apr. 2008, Townsend.

* cited by examiner

*Primary Examiner* — Christopher S Kim
(74) *Attorney, Agent, or Firm* — Nixon & Vanderhye, PC

(57) ABSTRACT

A rotary sprinkler includes: a shaft having a cam, the cam having a plurality of radially outwardly projecting cam lobes; a rotatable water distribution plate adapted to be impinged upon by a stream emitted from a nozzle causing at least the water distribution plate to rotate; a hesitator assembly including a stationary housing having a sealed chamber at least partially filled with a viscous fluid, with at least the cam and the cam lobes located within the chamber; a rotor ring located within the chamber in substantially surrounding relationship to the cam, the rotor ring loosely located within the chamber for rotation and translation, the rotor ring provided with at least two hesitator lobes projecting radially inwardly and movable laterally into and out of a path of rotation of the cam lobes, and a first plurality of radially outwardly projecting teeth selectively engageable with a second greater plurality of teeth provided on an inner wall of the housing; and wherein rotation of water distribution plate is slowed during intervals when one of the cam lobes engages and pushes past a respective one of the hesitator lobes, the cam lobe exerting both rotation and translation forces on the rotor ring, with one of the first plurality of teeth on the rotor engaging one of the second plurality of teeth on the housing wall.

6 Claims, 8 Drawing Sheets

SPRINKLER WITH GEARED VISCOUS HESITATOR AND RELATED METHOD

This application is a continuation-in-part of patent application Ser. No. 11/409,069, filed Apr. 24, 2006, now U.S. Pat. No. 7,584,904 the entire content of which is hereby incorporated by reference in this application.

BACKGROUND OF THE INVENTION

This invention relates to rotary sprinklers and, more specifically, to a rotary sprinkler having a stream interrupter or "hesitator" mechanism that operates in a controlled but non-repeating manner to achieve greater uniformity in the sprinkling pattern and/or to create unique and otherwise difficult-to-achieve pattern shapes.

Stream interrupters or stream diffusers per se are utilized for a variety of reasons, and representative examples may be found in U.S. Pat. Nos. 5,192,024; 4,836,450; 4,836,449; 4,375,513; and 3,727,842.

One reason for providing stream interrupters or diffusers is to enhance the uniformity of the sprinkling pattern. When irrigating large areas, the various sprinklers are spaced as far apart as possible in order to minimize system costs. To achieve an even distribution of water at wide sprinkler spacings requires sprinklers that simultaneously throw the water a long distance and produce a pattern that "stacks up" evenly when overlapped with adjacent sprinkler patterns. These requirements are achieved to some degree with a single concentrated stream of water emitted at a relatively high trajectory angle (approximately 24° from horizontal), but streams of this type produce a nonuniform "donut pattern". Interrupting a single concentrated stream, by fanning some of it vertically downward, produces a more even pattern but also reduces the radius of throw.

Proposed solutions to the above problem may be found in commonly owned U.S. Pat. Nos. 5,372,307 and 5,671,886. The solutions disclosed in these patents involve intermittently interrupting the stream as it leaves a water distribution plate so that at times, the stream is undisturbed for maximum radius of throw, while at other times, it is fanned to even out the pattern but at a reduced radius of throw. In both of the above-identified commonly owned patents, the rotational speed of the water distribution plate is slowed by a viscous fluid brake to achieve both maximum throw and maximum stream integrity. Commonly owned pending application Ser. No. 12/149,262 describes additional solutions based on the ability to create fast and slow-speed intervals of rotation for the rotating stream distributor plate.

BRIEF SUMMARY OF THE INVENTION

In one exemplary but nonlimiting implementation, the present invention relates to a rotating sprinkler that incorporates a hesitating mechanism (or simply "hesitator" assembly) that causes a momentary reduction in speed of the water distribution plate. This momentary dwell, or slow-speed interval, alters the radius of throw of the sprinkler. In the exemplary embodiments described herein, the hesitation or slow-speed interval occurs in a controlled but non-repeating manner, thus increasing the overall uniformity of the wetted pattern area. In one exemplary and nonlimiting embodiment, a cam is fixed to the water distribution plate shaft (referred to herein as the "shaft cam"), and is located in a sealed chamber containing a viscous fluid. The cam is formed with five convex cam lobes projecting radial outwardly at equally-spaced locations about the cam. Surrounding the shaft cam is a rotor ring that is able to rotate and move laterally within the chamber. The inner diametrical edge of the rotor ring is formed with a pair of diametrically opposed ring lobes (sometimes referred to herein as "hesitator lobes") adapted to be engaged by the shaft cam lobes. The outer diametrical edge of the rotor ring is formed with a pair of rotor teeth that are substantially circumferentially aligned with the hesitator lobes. At the same time, an inner surface of the housing is formed with teeth about the entire circumference thereof, and is adapted to be selectively engaged by the rotor teeth upon lateral movement of the rotor ring. Thus, when a hesitator lobe is struck by a shaft cam lobe, the rotation of the shaft and water distribution plate slows until the shaft cam lobe pushes the hesitator lobe out of its path, moving the rotor ring laterally but also causing some degree of rotation. By moving the rotor ring laterally, a second hesitator lobe is pulled into the path of another of the shaft cam lobes, such that a second slow-speed interval is set up. It will be appreciated that, due to the slight rotation of the rotor ring, and the geared engagement between the rotor ring and the housing, the fast and slow-speed intervals are implemented in a controlled but non-repeating manner, thus enhancing the uniformity or the "filling-in" of the circular wetted pattern area.

In a variation of this embodiment, the shaft to which the water distribution plate is mounted, is formed with (or fitted with) an irregularly-shaped cam having leading edge and heel portions. The inner diametrical edge of the rotor ring is formed with identical, radially inwardly projecting hesitator lobes about the entire inner periphery thereof. The outer diametrical edge is formed about its entire periphery with gear teeth adapted to engage similar teeth formed on an inner housing surface upon lateral movement of the rotor ring. Thus, as the shaft and shaft cam rotate, the cam leading edge portion will come into contact with one of the hesitator lobes, commencing the slow-speed interval. As the cam continues to rotate, it will push the hesitator lobe and rotor out of its way. Note that the engagement of rotor and housing teeth confine the lateral movement of the rotor ring, forcing the rotor to rotate away from the leading edge portion of the cam. This engagement between the rotor teeth and housing teeth is held for a period of rotation by the heel portion of the cam. Upon further rotation of the shaft and cam, the leading edge portion of the cam pushes beyond the hesitator lobe, ending the slow-speed interval and commencing the fast-speed interval. The leading edge portion of the shaft cam then engages the next hesitator lobe on the inner surface of the rotor ring, ending the fast-speed interval and commencing a new slow-speed interval.

Thus, in accordance with one aspect of the invention, there is provided a rotary sprinkler comprising: a shaft having a cam, the cam having a plurality of radially outwardly projecting cam lobes; a rotatable water distribution plate adapted to be impinged upon by a stream emitted from a nozzle causing at least the water distribution plate to rotate; a hesitator assembly including a stationary housing having a sealed chamber at least partially filled with a viscous fluid, with at least the cam and the cam lobes located within the chamber; a rotor ring located within the chamber in substantially surrounding relationship to the cam, the rotor ring loosely located within the chamber for rotation and translation, the rotor ring provided with at least two hesitator lobes projecting radially inwardly and movable laterally into and out of a path of rotation of the cam lobes, and a first plurality of radially outwardly projecting teeth selectively engageable with a second greater plurality of teeth provided on an inner wall of the housing; and wherein rotation of water distribution plate is slowed during intervals when one of the cam lobes engages and pushes past a respective one of the hesitator lobes, the cam lobe exerting both rotation and translation forces on the rotor ring, with one of the first plurality of teeth on the rotor engaging one of the second plurality of teeth on the housing wall.

In another aspect, the invention relates to a sprinkler device comprising: a sprinkler body having a nozzle and supporting a shaft having a cam mounted intermediate opposite ends of the shaft, a rotatable water distribution plate supported on one end of the shaft and adapted to be impinged upon by a stream emitted from a nozzle, said plate formed with grooves configured to cause at least said water distribution plate to rotate upon impingement of the stream; a hesitator assembly including a stationary housing supported in axially spaced relationship to said nozzle, and having a sealed chamber at least partially filled with a viscous fluid, with at least said cam located within said chamber; a rotor ring located within said chamber in substantially surrounding relationship to said cam, said rotor ring loosely located within said chamber for rotation and translation, having an inner peripheral edge formed with a plurality of hesitator lobes movable laterally into and out of a path of rotation of said cam, and an outer peripheral edge formed with a plurality of gear teeth selectively engageable with gear teeth on an inner surface of the stationary housing; and wherein rotation of the water distribution plate begins a slow-speed interval when said cam engages and pushes past a respective one of said hesitator lobes, causing said rotor ring to incrementally rotate and to simultaneously move laterally such that a first of said rotor gear teeth disengages from a tooth on the inner housing wall to begin a fast-speed interval, said fast-speed interval continuing until said cam engages another of said hesitator lobes to begin another slow speed-interval, such that a rotational position where said cam engages said hesitator lobes continually changes as said water distribution plate rotates.

The exemplary embodiments will now be described in detail in connection with the drawings identified below.

DETAILED DESCRIPTION OF THE DRAWINGS

Figure 1:
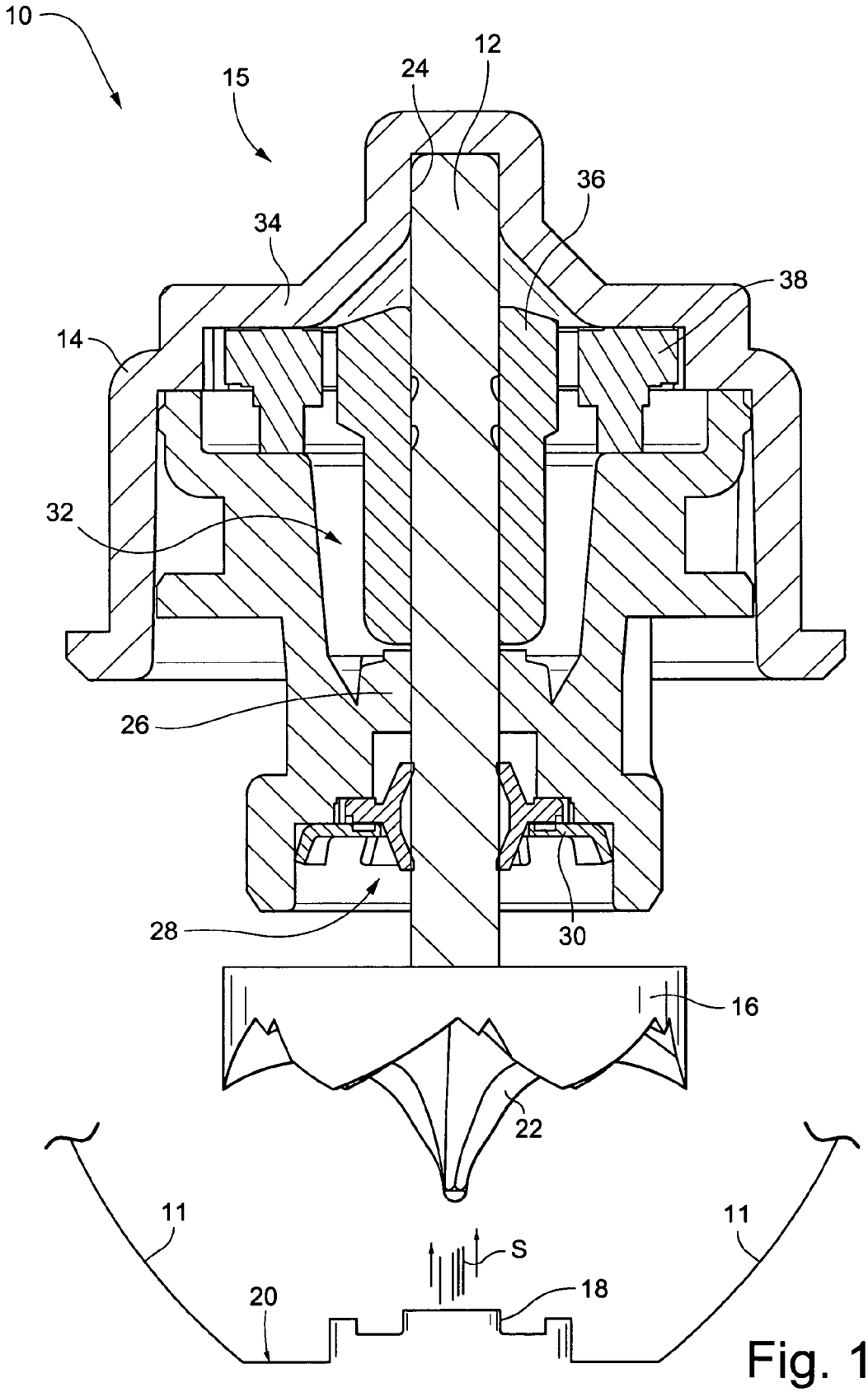
FIG. 1 is a cross section through a sprinkler incorporating a viscous hesitator device in accordance with an exemplary embodiment of the invention.
Figure 2:
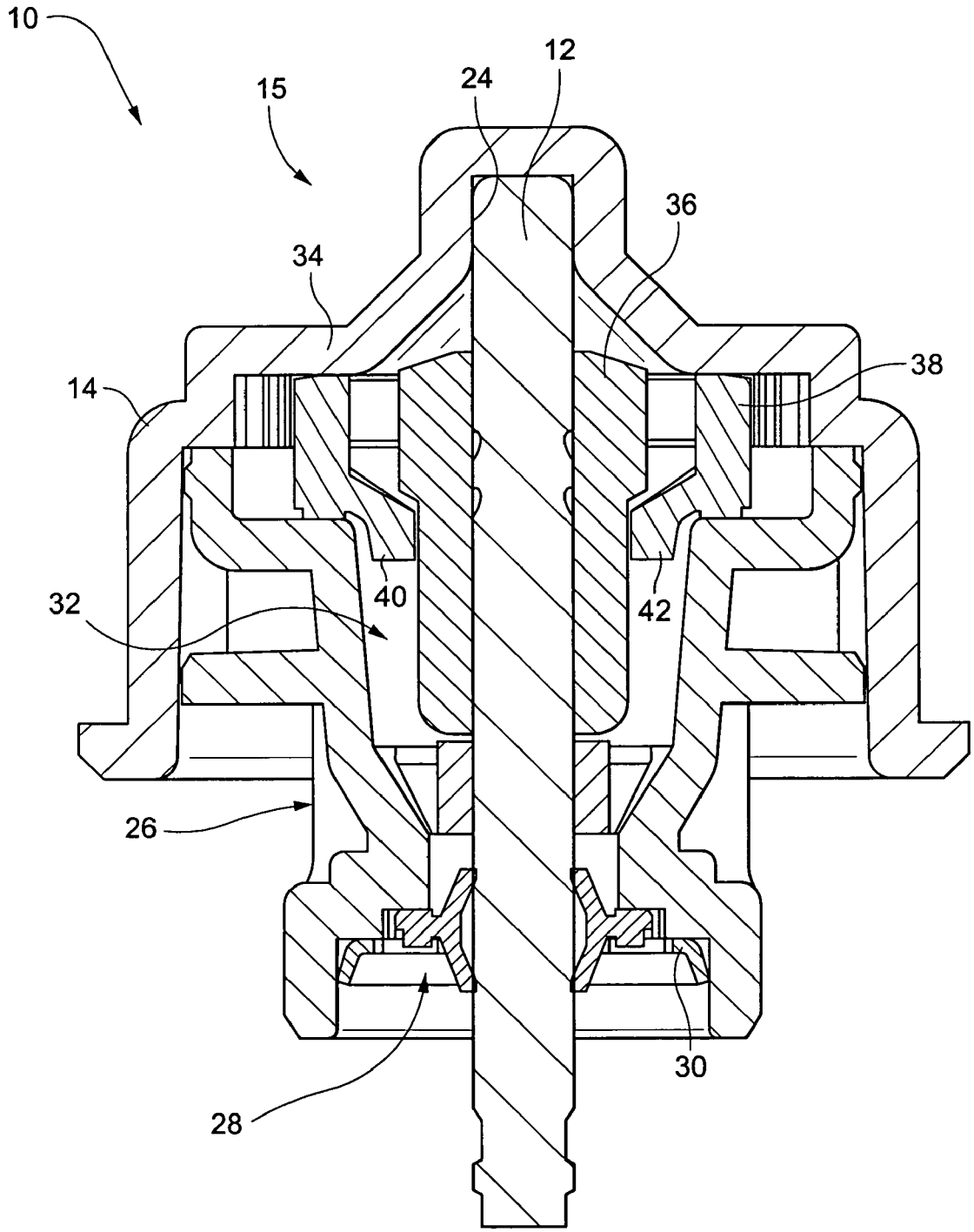
FIG. 2 is a cross section similar to that shown in FIG. 1, but with parts removed and rotated about 90°.
Figure 3:
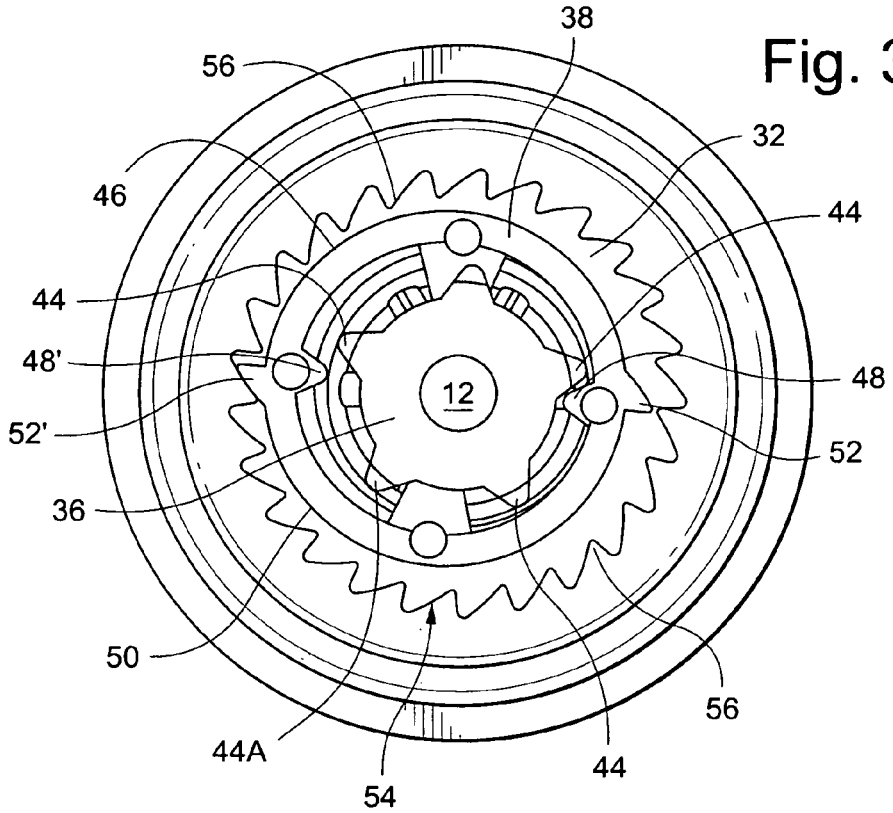
FIG. 3 is a plan view of the sprinkler shown in FIGS. 1 and 2, but with the top wall removed to reveal the interior parts.

Referring initially to FIGS. 1-3, a sprinkler incorporates a hesitator mechanism or assembly 10 that includes a shaft 12 secured in an upper component 14 of a two-piece housing 15. The free end of the shaft typically mounts a conventional water distribution plate 16 that substantially radially redirects a vertical stream (indicated by arrow S in FIG. 1) emitted from a nozzle 18 in the sprinkler body 20. The plate 16 is formed with one or more grooves 22 that are slightly curved in a circumferential direction so that when a stream emitted from the nozzle impinges on the plate 16, the nozzle stream is redirected substantially radially outwardly into one or more secondary streams that flow along the groove or grooves 22 thereby causing the plate 16 and shaft 12 to rotate about the longitudinal axis of the shaft.

One end of the shaft 12 is supported in a recess 24 within the upper component 14 of the housing 15, and at a location intermediate its length by an integral bearing 26 that is formed as the lower component of the two-piece housing 15. A conventional flexible double-lip seal 28 engages the shaft 12 where the shaft exits the housing, the seal held in place by a circular retainer 30.

It will be appreciated that the hesitator unit may comprise part of a removable cap assembly that is supported above (as viewed in FIG. 1) the nozzle 18 and the sprinkler body 20 by any suitable known means (e.g., one or more struts 11), such that the stream is emitted to atmosphere from the nozzle 18 and impinges on the water distribution plate 16, causing it to rotate about the axis of the shaft 12.

Within the upper component 14 of the housing 15, and specifically within a cavity 32 formed by, and extending axially between, the upper housing wall 34 and the bearing 26, a shaft cam 36 is fixed to the shaft 12 for rotation therewith. An annular rotor ring 38 surrounds the cam and is provided with tabs 40, 42 (FIG. 2) that maintain the rotor "on center" to the cam 36 but allow the rotor to slide back and forth within the cavity 32 as described in more detail further below. The cavity 32 is at least partially if not completely filled with viscous fluid (e.g., silicone) to slow the rotation of the shaft 12 (and hence the water distribution plate 16) at all times as well as rotational and lateral movement of the rotor ring 38. This viscous braking effect achieves a greater radius of throw as compared to a freely spinning water distribution plate. Accordingly, reference herein to fast and slow rotation intervals are relative, recognizing that both intervals are at speeds less than would be achieved by a freely spinning water distribution plate. Thus, reference to a slow-speed (or similar) interval will be understood as referring to an even slower speed than that caused by the constantly active viscous braking effect. Similarly, any reference to "fast" rotation simply means faster than the slower speed caused by the hesitation effect.

Figure 4:
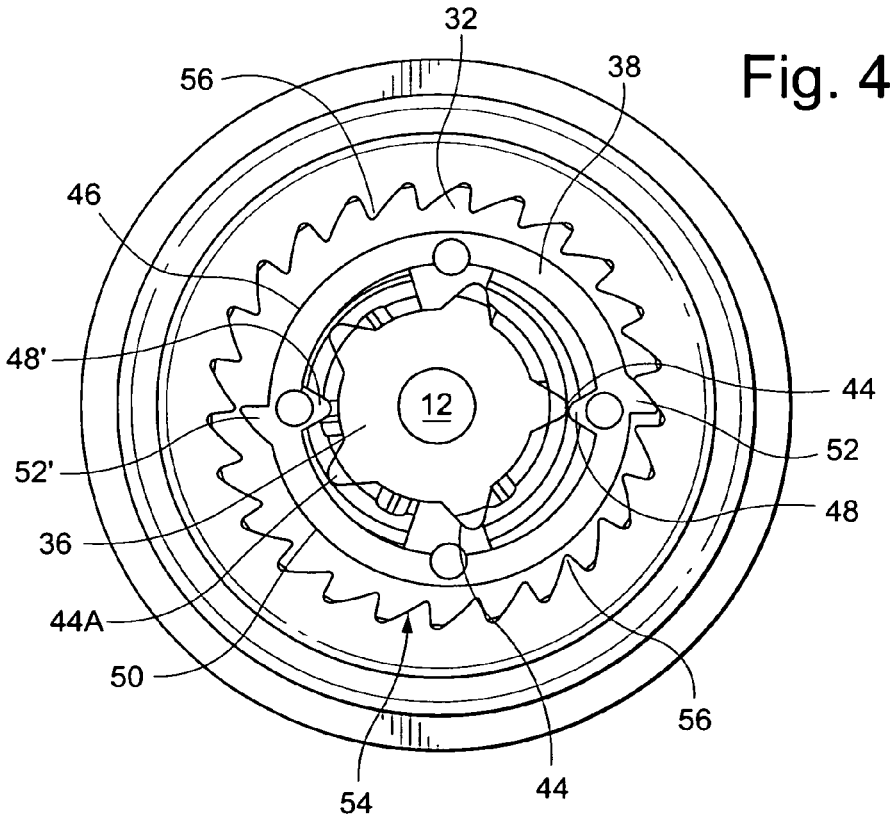
FIG. 4 is a view similar to FIG. 3, but with the shaft and shaft cam and rotor rotated incrementally in a clockwise direction.
Figure 5:
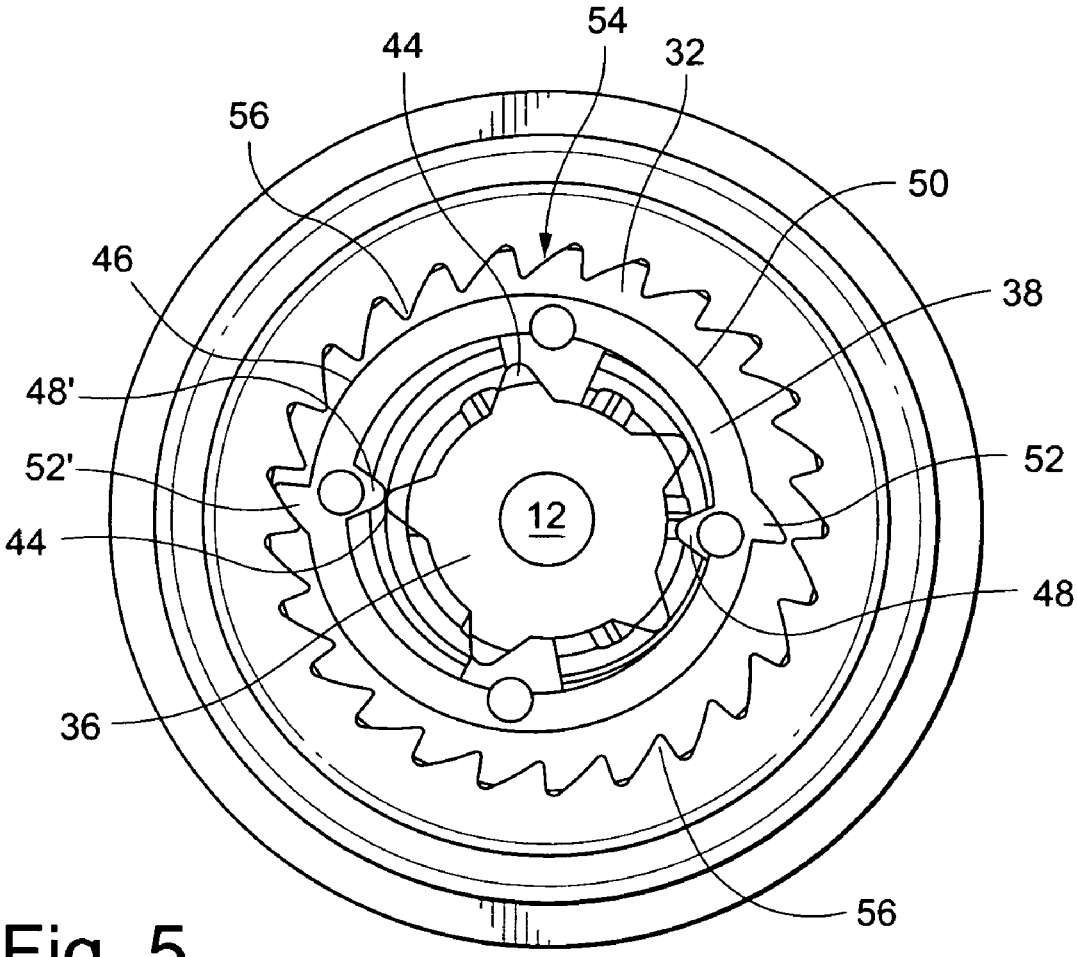
FIG. 5 is a view similar to FIG. 4 but with the shaft, shaft cam and rotor rotated incrementally further in the clockwise direction.
Figure 6:
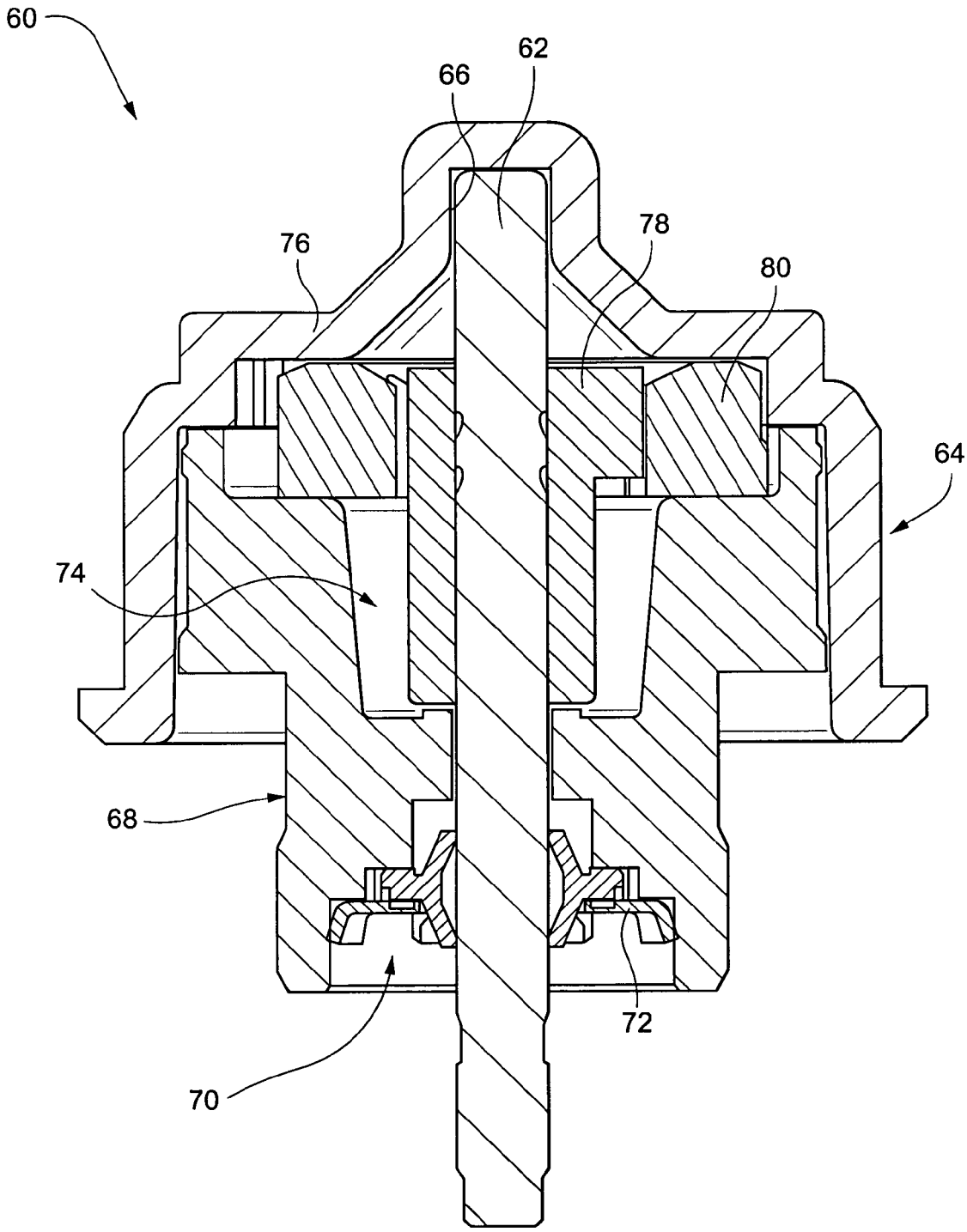
FIG. 6 is a partial section through a sprinkler hesitator mechanism in accordance with another exemplary but non-limiting embodiment.

As best appreciated from FIGS. 3-5, the placement of rotor ring 38 within the cavity 32 allows the rotor ring to "float", i.e., move both rotationally and laterally within the cavity 32. The shaft cam 36, as best seen in FIG. 3, is formed with a plurality (five in the exemplary embodiment) of smoothly curved, convex cam lobes 44 (or shaft cam lobes) projecting radially away from the cam 36, at equally-spaced circumferential locations. At the same time, the inner diametrical surface or edge 46 of the rotor ring 38 is formed with a pair of diametrically-opposed hesitator lobes 48, 48' projecting radially inwardly, and which are adapted to be engaged by the cam lobes 44 as the shaft 12 and cam 36 rotate. The interaction between the shaft cam lobes 44 and the hesitator lobes 48, 48' determines the rotational speed of the shaft 12 and hence the water distribution plate 16. The outer diametrical edge 50 of the rotor ring 38 is formed with a pair of rotor teeth 52, 52' that are in substantial radial alignment with the hesitator lobes 48, 48', respectively. An inner diametrical surface 54 of the housing is formed with teeth 56 about the entire circumference thereof, adapted to be selectively engaged by the rotor teeth 52, 52' as described in detail below.

More specifically, as the shaft 12 and cam 36 rotate in a clockwise direction as viewed in FIG. 3, a shaft cam lobe 44 will come into contact with the rotor or hesitator lobe 48, commencing a slow-speed interval. As the cam 36 continues to rotate (see FIGS. 3 and 4), the shaft cam lobe 44 will push the hesitator lobe 48 laterally out of its way. The rotor ring 38 must move sufficiently to pull the tooth 52' out of engagement with the diametrically opposed housing tooth 56. The cam 36 and shaft 12 will begin to rotate faster as the shaft cam lobe 44 clears the hesitator lobe 48, commencing the fast-speed interval. Meanwhile, the tooth 52 adjacent the hesitator lobe 48 will engage a tooth 56 on the housing wall. Note that the intermeshing tooth configuration is such that the rotor ring 38 will rotate incrementally until the tooth 52 is fully engaged. The shaft 12 and cam 36 remain in the fast mode until another shaft cam lobe 44A engages the hesitator lobe 48', commencing another slow-speed interval. This engagement causes the rotor ring 38 to move laterally to the left, pulling rotor tooth 52 out of engagement with a housing tooth 56, and pushing rotor tooth 52' into engagement with another, diametrically-opposed housing tooth 56, again with incremental rotation of the rotor ring 38.

It will be appreciated that when a rotor tooth 52 is pulled out of a housing tooth 56, and as the shaft cam lobe 44 pushes past a hesitator lobe 48, the rotor ring 38 will rotate an amount that is determined by the angles of the lobes on the cam 36 and on the rotor ring 38, as well as the shape of the teeth 52 and 56. The rotational speed during the slow-speed intervals is determined by how long it takes to push past a hesitator lobe on the rotor. The amount of rotation of the shaft 12 and cam 36 during a fast-speed interval is determined by the distance from when one of the shaft or cam lobes 44 pushes past a hesitator lobe 48 on the rotor 38 until another shaft or cam lobe 44 comes into contact with a hesitator lobe 48 on the opposite side of the rotor ring. Changing the geometry of the cam, rotor ring or both, as well as changing the viscosity of the fluid will allow for different fast/slow-speed patterns. The shaft cam lobes 44, hesitator lobes 48, rotor ring teeth 52 and housing teeth 56 are configured to insure a non-repeatable pattern in a 360-degree revolution, i.e., an area that was in the slow-speed rotation mode will not be in that same mode in the next revolution.

Turning now to FIGS. 6-9, another exemplary but nonlimiting embodiment of the invention is illustrated. Here, a hesitator sprinkler assembly 60 includes a shaft 62 secured in a similar two-piece housing 64. The free end of the shaft mounts a conventional water distribution plate (not shown but similar to plate 16) that substantially radially redirects a vertical stream emitted from a nozzle (not shown but similar to nozzle 18) in a sprinkler body (not shown, but similar to body 20).

Shaft 62 is supported within the housing 64 at one end in a recess 66, and at a location intermediate its length by an integral bearing 68 that is formed as part of the two-piece housing 64. A conventional flexible double-lip seal 70 engages the shaft where the shaft exits the housing, the seal held in place by a circular retainer 72.

Within the housing 64, and specifically within a cavity 74 formed by, and extending axially between, the upper housing wall 76 and the bearing 68, a shaft cam 78 is fixed to the shaft 62 for rotation therewith. An annular rotor ring 80 surrounds the shaft cam 78. The rotor ring 80, like rotor ring 38, is permitted to slide back and forth, and to rotate within the cavity 74 as described in more detail herein below. The cavity 74 is again at least partially if not completely filled with viscous fluid (e.g., silicone) to slow the rotation of the shaft 62 (and hence the water distribution plate) at all times, in a manner similar to that described above in connection with the embodiment shown in FIGS. 1-5.

Figure 7:
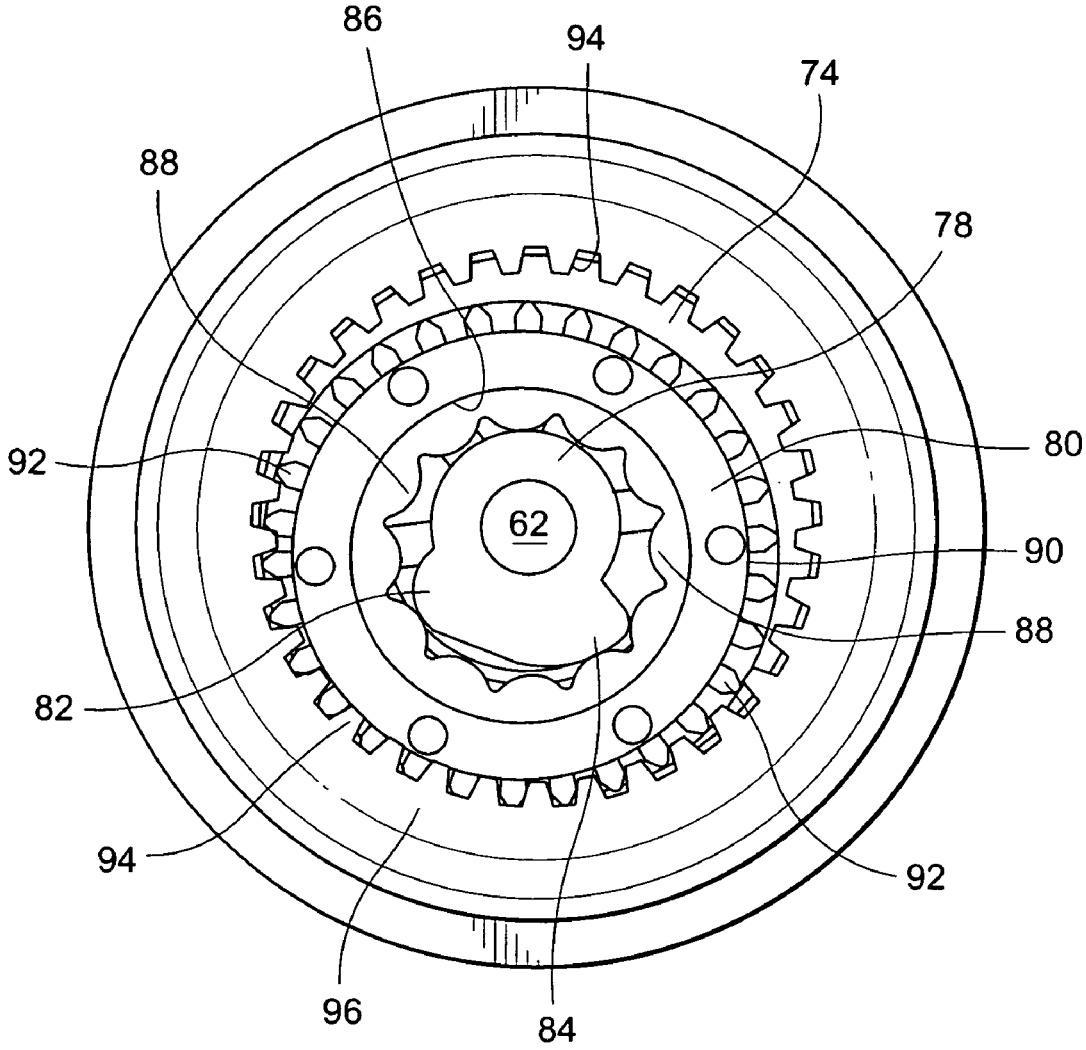
FIG. 7 is a plan view similar to the mechanism shown in FIG. 6 but with the top wall removed to reveal the interior parts.

More specifically, the placement of rotor ring 80 within the cavity 74 allows the rotor to "float", i.e., move both rotationally and laterally within the cavity 74. The irregularly-shaped shaft cam 78, as best seen in FIG. 7, is formed with a leading edge portion 82 and a heel or trailing edge portion 84 that extend radially away from the cam and shaft center axis, at predetermined circumferential locations. The inner diametrical surface or edge 86 of the rotor ring 80 is formed with a plurality of hesitator lobes 88 that are equally spaced about the entire inner periphery of the rotor, projecting radially inwardly as shown in FIG. 7. These hesitator lobes are adapted to be engaged by the leading edge and heel portions 82, 84, respectively, of the shaft cam 78 as the shaft 62 and cam 78 rotate. The interaction between the shaft cam lobe leading edge and heel portions 82, 84 and the hesitator lobes 88 determines the rotational speed of the shaft 62 and hence the water distribution plate. The outer diametrical edge 90 of the rotor ring 80 is formed about its entire periphery with gear teeth 92 that are adapted to engage similar gear teeth 94 formed on an inner diametrical surface or wall 96 of the housing, as described further below.

As the shaft 62 and cam 78 rotate in a clockwise direction, as viewed in FIG. 7, the cam leading edge portion 82 will come into contact with one of the hesitator lobes 88, commencing the slow-speed interval. As the shaft 62 and cam 78 continue to rotate, the leading edge portion 82 will push the hesitator lobe 88 and rotor ring 80 laterally out of its way. Note that the engagement of rotor ring and housing teeth confine the lateral movement of the rotor, but also permits the rotor ring 80 to rotate incrementally in the clockwise direction as viewed in FIG. 7. This engagement between the rotor teeth 92 and housing teeth 94 is held for a period of rotation by the heel portion 84 of the cam.

Figure 8:
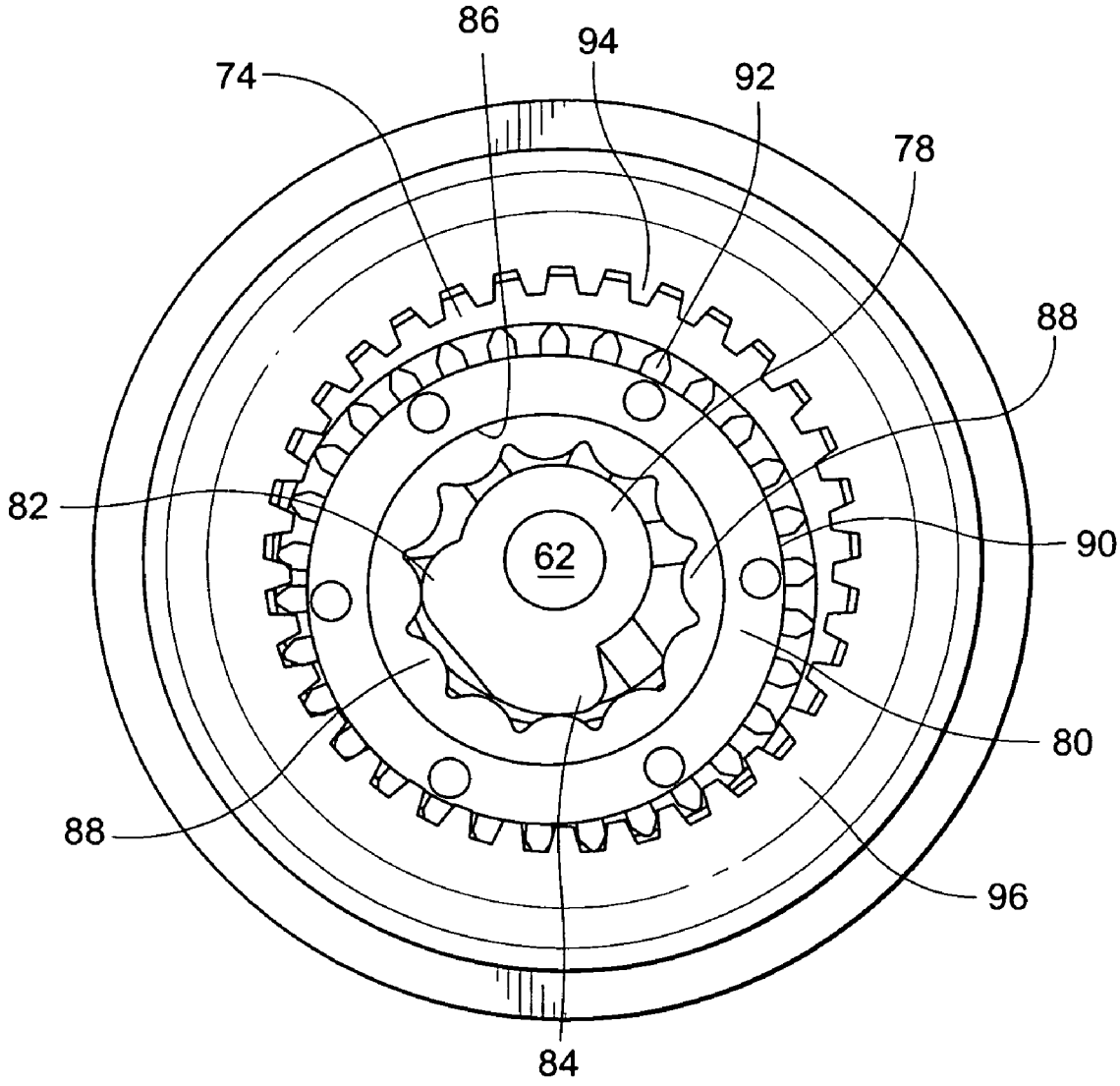
FIG. 8 is a plan view similar to that shown in FIG. 7, but with the shaft and shaft cam rotated incrementally in a clockwise direction.
Figure 9:
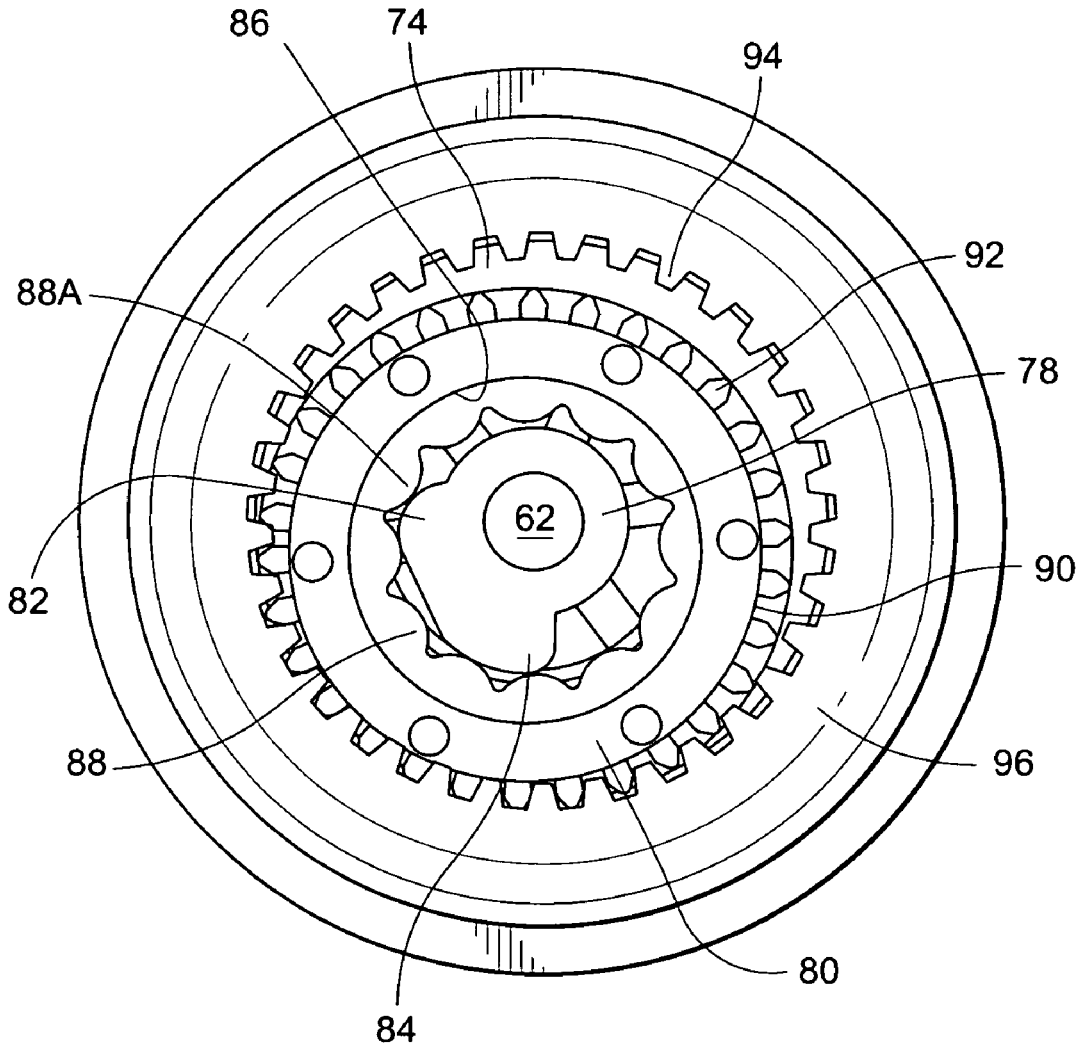
FIG. 9 is a plan view similar to that shown in FIG. 8 but with the shaft and shaft cam rotated incrementally further in the clockwise direction.

FIG. 8 illustrates further rotation of the shaft 62 and shaft cam 78, showing the leading edge portion 82 of the cam 78 pushing beyond the hesitator lobe 88, ending the slow-speed interval and commencing the fast-speed interval. In FIG. 9, the leading edge portion of the cam 82 engages the next hesitator lobe 88A on the inner surface of the rotor ring, ending the fast-speed interval and commencing a new slow-speed interval.

As in the previously described embodiment, the engagement between the rotor teeth 92 and the housing teeth 94 also ensures that a non-repeatable pattern will be developed as the shaft 62 and cam 78 rotate through successive 360-degree cycles. The amount of degrees rotated in the slow-speed interval is determined by the amount of cam rotation needed to push past a hesitator lobe 88. The slow rotation speed is determined by how long it takes for the shaft cam leading edge portion 82 to push past the hesitator lobe. The amount of degrees rotated in the fast-speed interval is determined by the distance the leading edge portion 82 of the shaft cam 78 travels as it pushes past a hesitator lobe 88 on the rotor ring until it comes into contact with the next hesitator lobe. Changing the geometry of the cam 78, rotor ring 80 or both, as well as changing the viscosity of the viscous fluid, will allow for different fast/slow speed patterns.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotary sprinkler comprising:

a shaft having a cam, said cam having at least one radially outwardly projecting cam lobe;

a rotatable water distribution plate on one end of said shaft adapted to be impinged upon by a stream emitted from a nozzle causing at least said water distribution plate to rotate;

a hesitator assembly including a stationary housing having a sealed chamber at least partially filled with a viscous fluid, with at least said cam and said at least one cam lobe located within said chamber, and a rotor ring located within said chamber in substantially surrounding relationship to said cam, said rotor ring loosely located within said chamber for rotation and translation, said rotor ring provided with at least two hesitator lobes projecting radially inwardly and movable laterally into and out of a path of rotation of said at least one cam lobe, said rotor ring further provided with a first plurality of radially outwardly projecting teeth selectively engageable with a second greater plurality of teeth provided on an inner wall of said housing; and wherein rotation of water distribution plate is slowed during intervals when said at least one cam lobe engages and pushes past a respective one of said at least two hesitator lobes, said cam lobe exerting both rotation and translation forces on said rotor ring, with one of said first plurality of teeth on said rotor engaging one of said second plurality of teeth on said housing wall.

2. The sprinkler device as in claim 1 wherein said hesitator lobes are substantially circumferentially aligned with said first plurality of radially outwardly projecting teeth.

3. The sprinkler device as in claim 2 wherein said at least one cam lobe comprises five cam lobes which, upon successive engagement and disengagement with said at least two hesitator lobes, produces non-repeating relatively slow and fast-speed intervals during rotation of said shaft and water distribution plate, thereby causing a radius of throw of the stream to be increased and decreased, respectively.

4. The sprinkler device of claim 1 wherein said at least one cam lobe comprises two cam lobes and wherein engaging surfaces of said two cam lobes and said at least two hesitator lobes are shaped such that, as a first one of said two cam lobes pushes past an engaged hesitator lobe, the rotor ring moves laterally, pulling the other of said at least two hesitator lobes into a path of rotation of a second oncoming one of said two cam lobes.

5. The sprinkler device of claim 3 wherein engaging surfaces of each of said five cam lobes and hesitator lobes are shaped such that, as one of said five cam lobes pushes past an engaged one of said at least two hesitator lobes, the rotor ring moves laterally, pulling the other of said at least two hesitator lobes into a path of rotation of an oncoming one of said five cam lobes while said rotor ring rotates to a new position.

6. The sprinkler device of claim 1 wherein said hesitator assembly is supported on an opposite end of the shaft.

* * * * *